United States Patent [19]

Deneau

[11] 4,452,153

[45] Jun. 5, 1984

[54] ROTARY HEARTH PYROLYZER WITH TAPERED SPREADER ROLL

[75] Inventor: Kenneth S. Deneau, Toledo, Ohio

[73] Assignee: Midland-Ross Corporation, Cleveland, Ohio

[21] Appl. No.: 340,650

[22] Filed: Jan. 19, 1982

[51] Int. Cl.[3] ..... F23G 5/04

[52] U.S. Cl. ..... 110/247; 222/408; 110/225; 110/101 CD

[58] Field of Search ..... 110/247, 225, 256, 235, 110/248, 101 CD; 222/408, 214

[56] References Cited

U.S. PATENT DOCUMENTS

| | | | |
|---|---|---|---|
| 1,104,288 | 7/1914 | Beskow et al. | 222/408 |
| 1,993,688 | 3/1935 | Specketer et al. | 110/247 |
| 2,896,824 | 7/1959 | Sheldon | 222/408 |
| 3,671,167 | 6/1972 | Nakano | 110/247 |
| 3,680,503 | 8/1972 | Danielsson et al. | 110/247 |
| 3,985,098 | 10/1976 | Myers et al. | 222/414 |
| 4,182,246 | 1/1980 | Lombana et al. | 110/225 |
| 4,215,981 | 8/1980 | von Dreusche, Jr. | 110/225 |
| 4,311,102 | 1/1982 | Kolze et al. | 110/101 CD |

FOREIGN PATENT DOCUMENTS

| | | | |
|---|---|---|---|
| 2022227 | 12/1979 | United Kingdom | 110/247 |

*Primary Examiner*—Henry C. Yuen

*Attorney, Agent, or Firm*—Harlan E. Hummer

[57] ABSTRACT

A rotary hearth pyrolyzer is described as having a conically tapered roll for uniformly spreading waste material that is charged onto the hearth for pyrolyzation. The taper of the spreader roll is such that the linear speed at any point measured longitudinally of the roll corresponds to the speed of the rotary hearth at a point on the hearth opposite the point on the spreader roll. An angularly disposed scraper blade is positioned slightly downstream of the spreader roll, relative to the movement of the rotary hearth, and has a pair of marginal edges, one of which engages the spreader roll to remove waste material sticking thereto and the other of which edges terminates in spaced relation from the hearth to evenly spread or distribute waste material onto the hearth.

9 Claims, 3 Drawing Figures

ROTARY HEARTH PYROLYZER WITH TAPERED SPREADER ROLL

BACKGROUND OF THE INVENTION

The invention is particularly well suited for use in a rotary hearth pyrolyzer which has an annular hood and chamber in which an annular hearth rotates in a horizontal plane about the fixed center axis of the hood. Solid or semi-solid waste material dumped onto the rotary hearth, is, at present, distributed over the rotary hearth by means of a cylindrical spreader roll which extends transversely across the hearth. A scraper blade is provided on the downstream side of the spreader roll, relative to the directional movement of the rotary hearth, to remove solid waste material which sticks to the roll.

It can be appreciated by those skilled in the art that the inner and outer peripheries of the rotary hearth move at different speeds, because of the variance in their circumferential lengths. A cylindrical roll is simply not capable of accommodating this differential in speeds, thereby creating nonuniformity of the thickness of material being spread on the hearth. The invention is directed to the provision of a highly improved spreader roll and scraper blade assembly for producing a more uniformly thick bed of solid waste material on the rotary hearth.

Briefly stated, the invention is in a pyrolyzer having an annular hood and chamber in which is disposed an annular hearth which is mounted for rotation in a horizontal plane about a fixed, vertical axis. The annular hearth has inner and outer circular marginal edges or peripheries which rotate at different speeds, depending on the radial distances they are spaced from each other and the vertical axis about which the hearth rotates. A conically tapered spreader roll is disposed in the chamber immediately downstream from the inlet through which solid waste material is fed onto the rotary hearth for distributing the material evenly on the hearth. The tapered spreader roll extends transversely across the hearth and is conically tapered in decreasing circumferential length in a direction of the rotational axis of the hearth. The taper of the spreader roll is such that at any point measured longitudinally of the roll, the linear speed of the roll at such point equals the linear speed of the hearth at a point on the hearth opposite such point on the roll.

A scraper blade is disposed downstream of the tapered spreader roll in angular relation to the hearth and has a pair of opposing marginal edges, one of which edges engages the downstream side of the roll to remove solid waste material sticking thereto, and the other of which marginal edges terminates in parallel relation from the hearth to evenly distribute waste material on the hearth. Thus, both the scraper and roll coact to produce a more uniform supply of solid waste material on the hearth.

DESCRIPTION OF THE DRAWINGS

The following description of the invention will be better understood by having reference to the accompanying drawing, wherein.

ENVIRONMENT OF THE INVENTION

Figure 1:
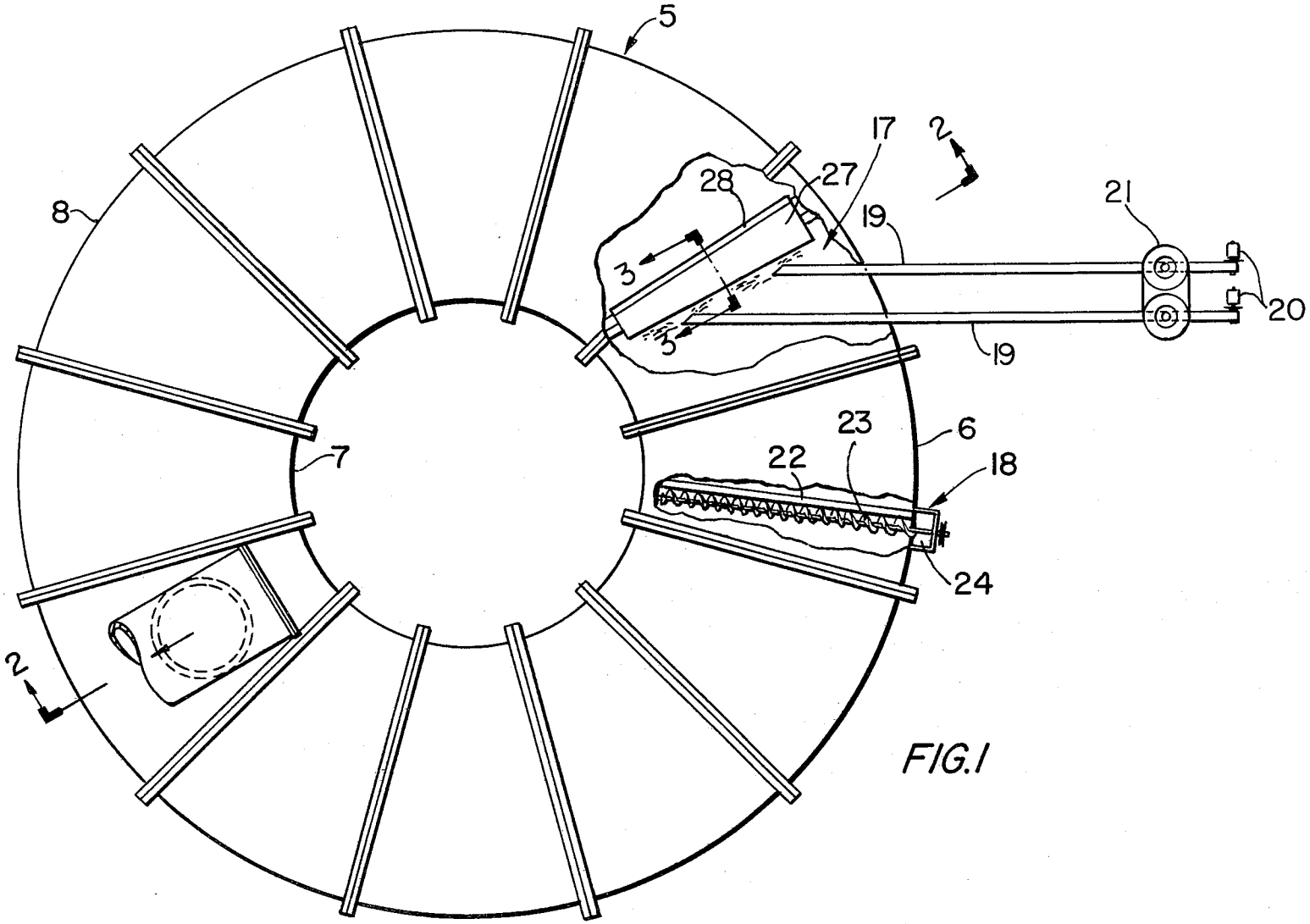
FIG. 1 is a plan view of a rotary hearth pyrolyzer which is made in accordance with the invention and has certain portions removed to better illustrate the invention.
Figure 2:
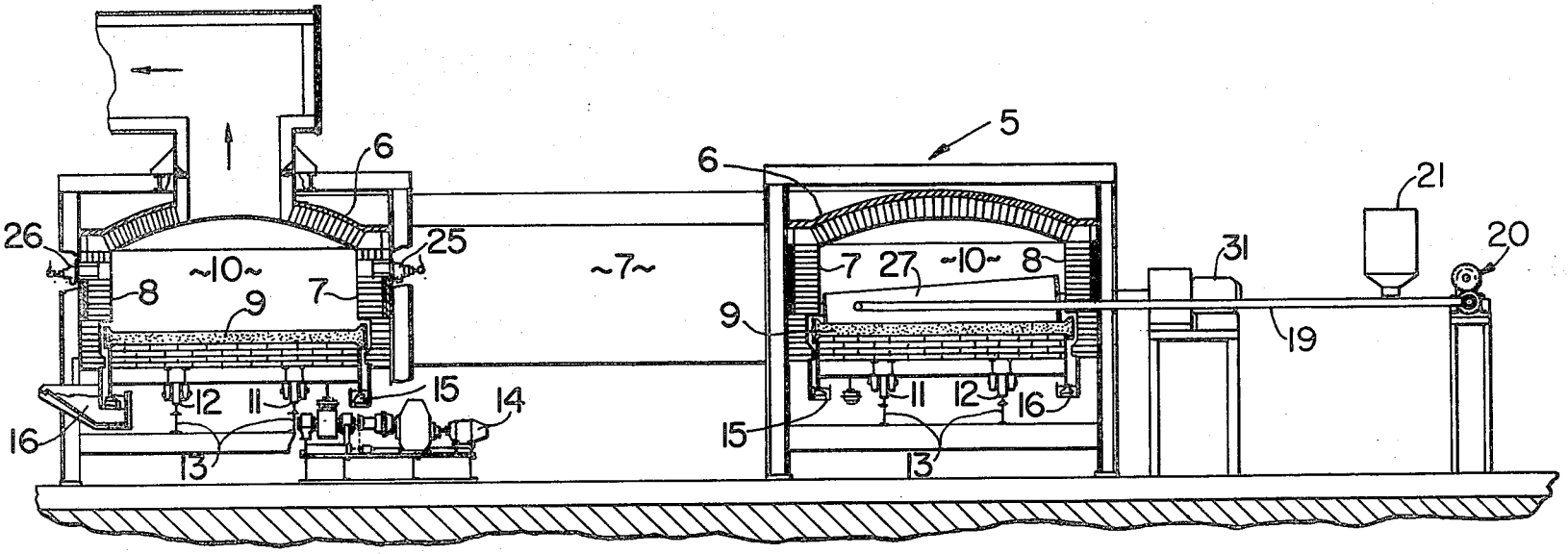
FIG. 2 is a section of the pyrolyzer viewed from the line 2—2 of FIG. 1.

With reference to the drawing, there is shown a rotary hearth pyrolyzer 5 which comprises, an inverted U-shaped, annular, refractory lined housing or hood 6 that has a pair of vertically disposed inner and outer cylindrical sidewalls 7,8 which are in radial spaced relation, and an annular, refractory lined hearth 9 that is disposed in the hood 6 between the sidewalls 7,8 and which forms with the hood, a heat treatment chamber 10. The hearth 9 is mounted for rotation in a horizontal plane about the vertical center axis of the hood 6 by any suitable means. For example, the hearth 9 is mounted on pairs of wheels 11,12 that are movable along a fixed trackway 13 which is positioned vertically below the hood 6. Any suitable means, including a drive motor 14, is operatively connected to the rotary hearth 9 for rotating it in the chamber 10. Annular water or sand seals 15,16 are provided between the rotary hearth 9 and adjacent sidewalls 7,8 of the hood 6 to seal the chamber 10 from the ambient atmosphere.

Any suitable means can be used for charging and discharging waste material to and from the rotary hearth 9. For example, the chamber is provided with an inlet 17 through which solid waste is charged to the rotary hearth 9 and an outlet 18 through which pyrolyzed waste is removed from the rotary hearth 9. Depending on the width of the rotary hearth 9, one or a plurality of similar screw auger feeders 19 are used to convey solid waste to the inlet 17 for deposit on the rotary hearth 9. Any appropriate means 20, e.g. motor and gear train, are provided to rotate the augers of the feeders 19 which extend angularly through the cylindrical outer wall 8 of the pyrolyzer 5 in parallel relation vertically above the rotary hearth 9. Any suitable means 21 are used to convey solid waste to the feeders 19 which are operated in sychronized relation with the rotation of the hearth 9 to insure that a continuous supply of solid waste material is fed onto the rotary hearth 9.

A plow 22 is located in the outlet 18 and extends transversely across the rotary hearth 9 to prevent pyrolyzed waste material from passing beyond the outlet 18 into the area of the inlet 17 of the pyrolyzer 5. A rotating auger 23 is positioned immediately upstream from the plow 22, relative to the direction in which the rotary hearth 9 moves, to transport or move the pyrolyzed waste or char into a discharge chute 24 from which the char is removed from the cite of the pyrolyzer 5.

A plurality of burners 25,26 are spaced around the inner and outer cylindrical sidewalls 7,8 of the hood 6 to direct hot gaseous products of combustion into the chamber 10 to heat the refractory lined hood and hearth and create within the chamber 10, a heated gaseous atmosphere for pyrolyzing the solid waste charged to the rotary hearth 9.

THE INVENTION

A tapered spreader roll 27, positioned transversely in the chamber 10 immediately downstream from the feed chutes 19 of the inlet 17, is used to distribute the solid waste uniformly over the rotary hearth 9. The spreader roll 27 is composed of any suitable material, e.g. stainless steel, and is in predetermined spaced relation from the hearth and is conically tapered in circumferentially decreasing size in the direction of the inner cylindrical wall 7 of the hood 6 or rotational axis of the rotary hearth 9. The taper of the spreader roll 27 is preferably such that at any point measured longitudinally along the spreader roll 27, the linear speed at such point corresponds to the linear speed at a point on the rotary hearth 9 that is directly opposite such point on the spreader roll 27. Thus, the tapered spreader roll 27 truly rotates at the speed of the rotary hearth 9, unlike cylindrical rolls whose speed along the roll is constant and not variable to accommodate different speeds at which the inner and outer peripheries of the annular hearth move. In some instances, it may be desirable to overdrive or underdrive the tapered spreader roll 27, i.e. rotate the spreader roll 27 up to 50% faster or slower than the speed at which the rotary hearth 9 travels.

It can be appreciated that the taper will vary, depending on the size of the rotary hearth 9 and the radial distance that it is spaced from its rotational axis. In smaller applications, it was found impractical to size the spreader roll 27 to match the rotary speeds at opposing marginal edges of the rotary hearth 9. The taper of the spreader roll 27 was compromised, so that its larger diameter end rotated at one-half the speed of the rotary hearth 9 at a corresponding point, while its smaller diameter end rotated at twice the speed of the rotary hearth 9 at a corresponding point. This particular design worked well in spreading material evenly on the rotary hearth 9. Based on this, it is theorized that the taper of the spreader roll will be adequate, if the ratio of the correlated speeds of the rotary hearth and spreader roll at opposing ends of the spreader roll, does not exceed 2 to 1.

Figure 3:
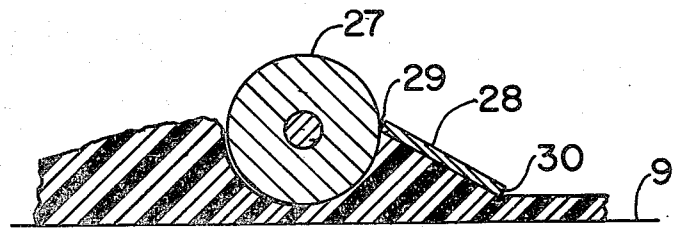
FIG. 3 is a section of the tapered spreader roll and scraper blade assembly viewed from the line 3—3 of FIG. 1.

The tapered spreader roll 27, as best seen in FIG. 3, is used in conjunction with a planar scraper blade 28 which is positioned immediately downstream of the spreader roll 27 in angular relation to the plane of the rotary hearth 9 so that it converges towards the hearth in a downstream direction. The scraper blade 28 is composed of any suitable material, e.g. stainless steel, and has a pair of longitudinally extending opposing marginal edges 29,30, one of which edges 29 contacts the spreader roll 27 to remove solid waste material that sticks to the roll, and the other of which edges 30 terminates in parallel relation from the rotary hearth 9 a distance which is approximately within ±50% of the spacing of the spreader roll 27 from the hearth to evenly spread waste material on the rotary hearth 9 for subsequent pyrolyzation. The assembly of tapered spreader roll 27 and uniquely angled scraper blade 28 provide a good, uniform distribution of waste material on the rotary hearth.

Thus, there has been described a unique, conically tapered spreader roll and scraper blade assembly which is designed to provide a more uniformly thick bed of solid waste on a rotary hearth. The spreader roll 27 is rotated harmoniously in sychronized relation with the rotary hearth 9 by any suitable means 31 which can be a part of, or apart from, the drive motor 14 and gear train of the mechanism for rotating the hearth 9.

What is claimed:

1. A pyrolyzer, comprising:

(a) a housing having an annular chamber generally sealed from the ambient atmosphere, the housing including an inlet through which material, to be pyrolyzed, enters the chamber and an outlet through which pyrolyzed material exits the chamber;

(b) an annular hearth disposed in the chamber for supporting the material as it is being pyrolyzed, the hearth having a curved inner periphery in radially spaced relation from a curved outer periphery which is circumferentially longer than the inner periphery;

(c) means for mounting the hearth for rotation in a horizontal plane about a fixed vertical axis;

(d) a roll disposed in the hearth just downstream from the inlet, relative to the direction of movement of the hearth, for contacting material charged to the hearth and spreading it evenly on the hearth, the spreader roll extending transversely of the hearth and being conically tapered in circumferentially decreasing size in the direction of the inner periphery of the hearth.

2. The pyrolyzer of claim 1, which includes;

(e) a scraper blade immediately downstream of the spreader roll and coextensive with the roll, the blade being angularly disposed to the hearth and converging towards the hearth in a downstream direction, the blade having a pair of opposing marginal edges, one of which edges contacts the spreader roll to remove material sticking thereto, and the other of which edges terminates in parallel relation from the hearth a distance which is within ±50% of the spacing between the roll and hearth, to uniformly distribute material on the hearth.

3. The pyrolyzer of claim 2, wherein the taper of the spreader roll is such that the ratio of the correlated speeds of the rotary hearth and spreader roll at opposing ends of the spreader roll does not exceed 2 to 1.

4. The pyrolyzer of claim 3, wherein the taper of the spreader roll is such that at any point longitudinally of the roll, the linear speed of the roll at such point is capable of equaling the linear speed of the hearth at a point on the hearth opposite such point on the roll.

5. The pyrolyzer of claim 4, wherein the inlet of the chamber includes: (I) at least one feeder with a rotating auger extending through the housing and terminating in spaced relation upstream of the spreader roll for depositing material on the rotary hearth, and (II) means for rotating the auger in synchronized relation with movement of the rotary hearth.

6. The pyrolyzer of claim 5, which includes: a plow extending transversely across the hearth adjacent the outlet to prevent pyrolyzed material from passing beyond the outlet into the area of the inlet; and a rotatable auger for moving pyrolyzed waste, building up adjacent the plow, from the hearth through the outlet.

7. The pyrolyzer of claim 6, wherein the housing has a pair of vertically disposed opposing cylindrical sidewalls, and a plurality of burners spaced around each of the sidewalls for directing hot gaseous products of combustion into the chamber.

8. The pyrolyzer of claims 1, 4, or 7, which includes means for rotating the spreader roll, at a predetermined speed which is correlated to the speed at which the hearth rotates.

9. The pyrolyzer of claim 8, where at least the surfaces of the spreader roll and scraper blade contacting the material are composed of stainless steel.

* * * * *